US005795174A

United States Patent [19]

Saito et al.

[11] Patent Number: 5,795,174

[45] Date of Patent: Aug. 18, 1998

[54] MULTI-CONNECTOR SUPPORTING DEVICE WITH CONNECTION/DISCONNECTION MECHANISM

[75] Inventors: Kazuki Saito; Sunao Sekiguchi; Hisashi Ishida, all of Tokyo, Japan

[73] Assignee: Japan Aviation Electronics Industry, Limited, Tokyo, Japan

[21] Appl. No.: 623,174

[22] Filed: Mar. 28, 1996

[30] Foreign Application Priority Data

Mar. 29, 1995 [JP] Japan ..... 7-071462
Mar. 29, 1995 [JP] Japan ..... 7-071521

[51] Int. Cl.[6] ..... H01R 13/62

[52] U.S. Cl. ..... 439/310; 439/347

[58] Field of Search ..... 434/310, 347, 434/152–160, 701

[56] References Cited

U.S. PATENT DOCUMENTS 4,352,533 10/1982 Murase et al. ..... 439/310 X
4,586,771 5/1986 Kraemer et al. ..... 439/310 X
4,883,429 11/1989 Suzuki et al. ..... 439/310 X
5,035,634 7/1991 Hasircoglu et al. ..... 439/310 X

*Primary Examiner*—Khiem Nguyen
*Attorney, Agent, or Firm*—Laff, Whitesel, Conte & Saret, Ltd.

[57] ABSTRACT

A multi connector device comprising a plurality of connector pairs of first connectors and second connectors mating therewith, and a multi-connector support housing for accommodating the connector pairs. The multi-connector support housing comprises a support housing defining a plurality of connector accommodating chambers therein which are arranged in order and accommodate the connector pairs therein, respectively. A plurality of pairs of guide engaging portions are formed on the support housing at the connector accommodating chambers and engaging the connector pairs accommodated in the chambers and guiding the connector pairs to move in connecting and disconnecting directions in the chambers, respectively. A slider as a connector driving member is removably assembled onto the support housing to drive the connector pairs in a selected one of the connecting and disconnecting directions. In a specific structure, the support housing comprises two housing members which are removably jointed together to form the support housing and accommodate the first connectors and the second connectors, respectively.

15 Claims, 16 Drawing Sheets

MULTI-CONNECTOR SUPPORTING DEVICE WITH CONNECTION/DISCONNECTION MECHANISM

BACKGROUND OF THE INVENTION

The present invention relates to electrical cable connectors and, in particular, to a support of a plurality of electrical cable connectors.

In the prior art, a pair of electrical cable connectors are used for electrically and mechanically connecting/disconnecting a cable to/from another cable or cables to/from other cables.

There are many electrical apparatus, such as an electronic computer, which use a large number of, for example, several thousands pairs of cable connectors for connecting/disconnecting a great number of, for example, several ten thousands electrical cables to/from one another. In connecting a particular pair of connectors to each other, it is complex and troublesome to find out the particular two corresponding or mating connectors in many connectors. In disconnecting a particular pair of connectors connected, it is also complex and troublesome to find out the particular pair in many connector pairs connected.

In order to reduce the complexity, it has been practiced to give indications of different numbers assigned to different pairs of connectors. However, it is still complex and troublesome to find out a pair connectors having a particular number and to find out two connectors having a same number in many pairs of connectors.

Furthermore, it is complex and time consuming task to connect many pairs of connectors one by one.

SUMMARY OF THE INVENTION

Therefore, it is an object of the present invention to provide a multi-connector supporting device with a connecting/disconnecting mechanism in which a plurality of pairs of cable connectors are accommodated and supported in good order and are capable of being connected/disconnected by the mechanism.

It is another object of the present invention to provide a multi-connector device wherein a plurality of pairs of connectors are accommodated and supported in a support in good order and can be connected/disconnected by a simple mechanism.

According to the present invention, a multi-connector support device with a connection/disconnection mechanism can be obtained which comprises a support housing defining a plurality of connector accommodating chambers arranged in order for accommodating a plurality of pairs of connectors therein, respectively. The support housing has a plurality of pairs of guide engaging portions at the connector accommodating chambers for engaging the pairs of connectors accommodated in the chambers and guiding the pairs of connectors to move in connecting and disconnecting directions in the chambers, respectively. A connector driving member is assembled onto the support housing to drive the pairs of connectors to move in a selected one of the connecting and disconnecting directions.

According to a specific aspect, the support housing has a pair of housing members which are removably jointed to each other, one of the pair of housing members being for accommodating a plurality of connectors and the other being for accommodating other connectors mating thereto. The pairs of guide engaging portions are separately provided onto the pair of housing members, respectively.

DESCRIPTION OF PREFERRED EMBODIMENTS

Prior to description of preferred embodiments of the present invention, the known art is described.

Figure 1:
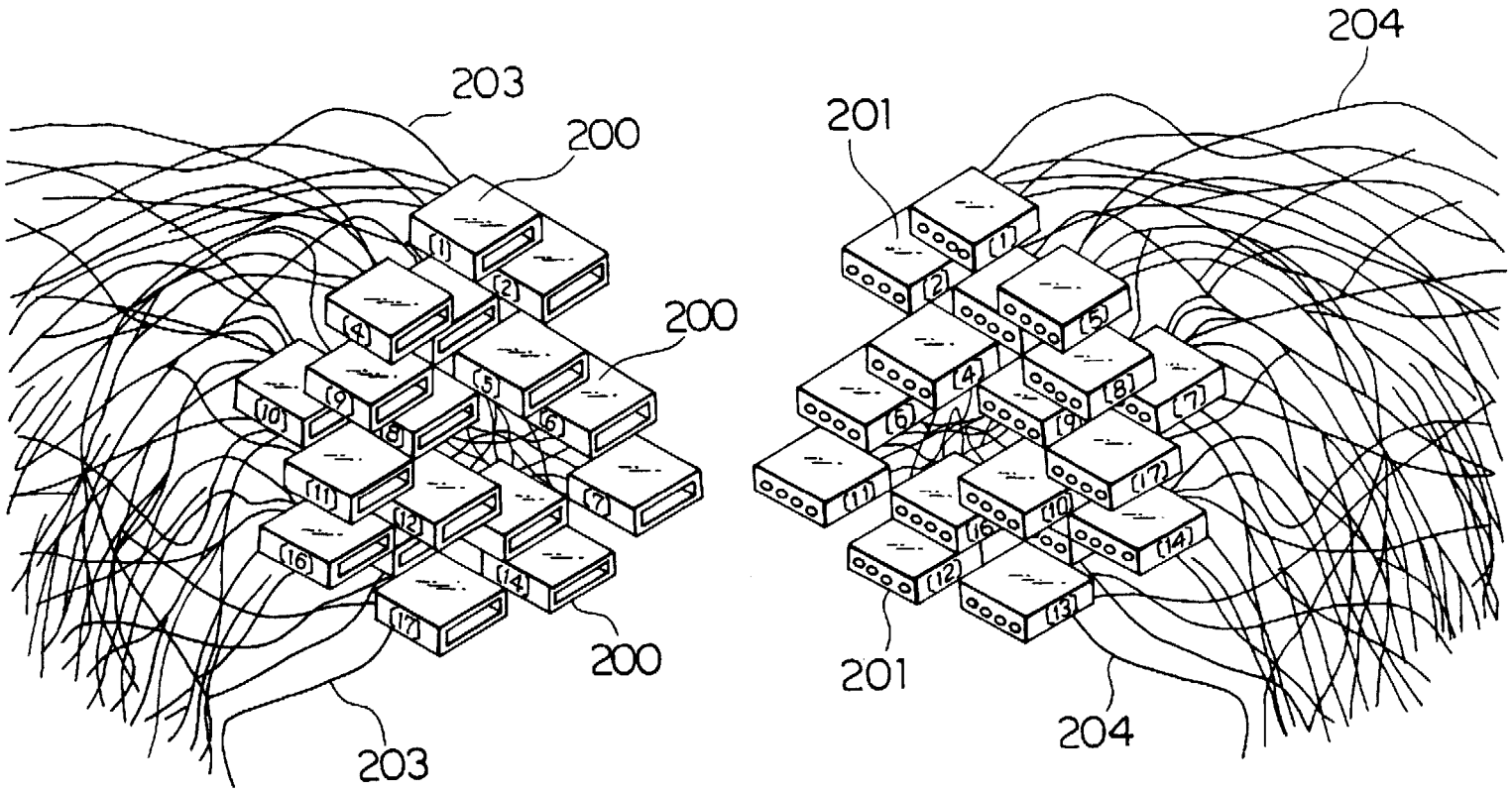
PRIOR ART FIG. 1
FIG. 1 is a perspective view illustrating a known practical use of a plurality of electrical cable connectors which are shown in a disconnected state.

Referring to FIG. 1, there are many pairs of electrical cable connectors 200 and 201 for connecting a large number of electrical cables 203 to another large number of electrical cables 204 one another. A particular one of connectors 200 accommodates particular cables 203 and a specific one of connectors 201 mating the particular connector accommodates specific cables 204 to be connected to the particular cables 203. The particular and the specific connectors form a pair of connectors.

It is difficult to find out a particular connector 200 accommodating a particular cable 203 and a specific connector 201 accommodating a specific cable 204 to be connected to the specific cable in the many connectors, even if indications of same connector numbers would be given to connector pairs as shown by numerals in brackets in the figure.

Furthermore, it is a time consuming task to connect/disconnect many pairs of connectors 200 and 201 one by one.

Figure 2:
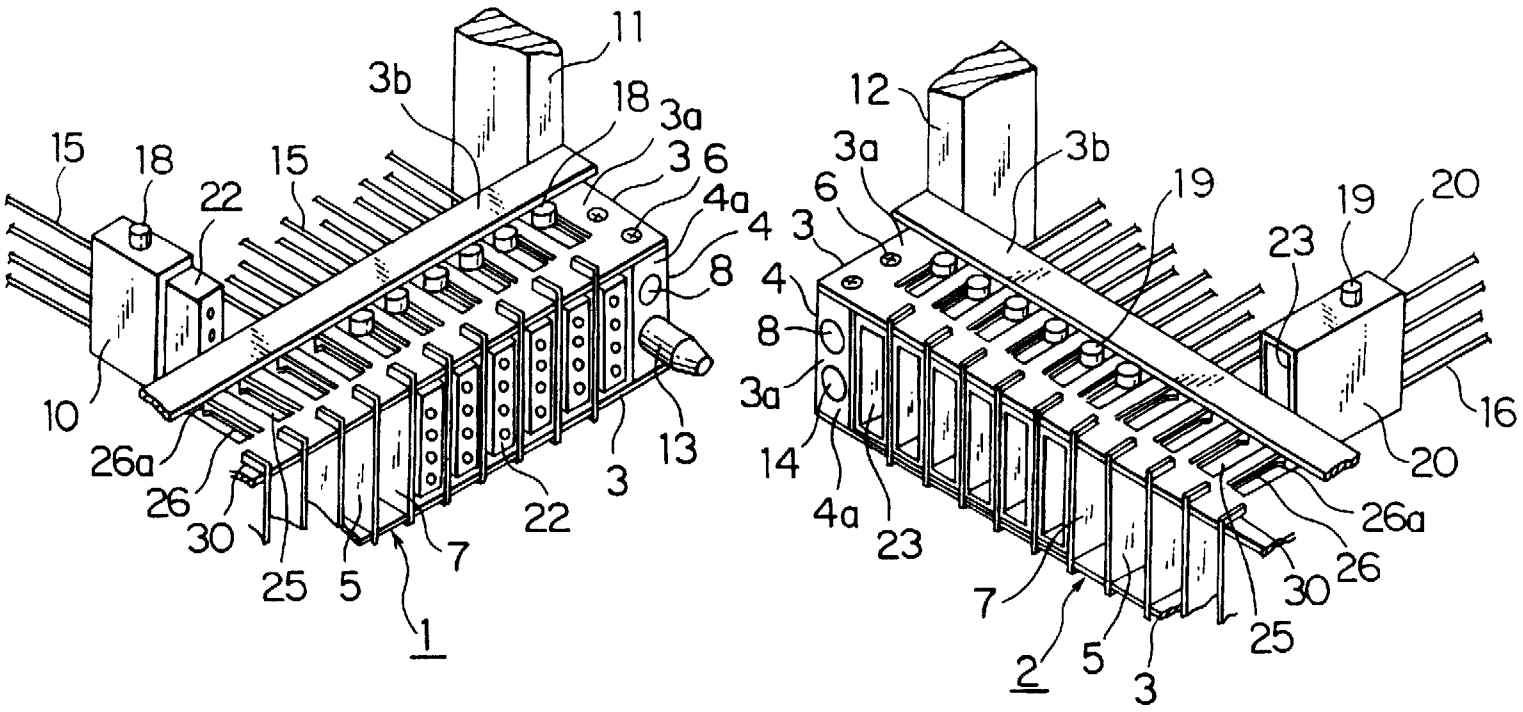
FIG. 2 is a perspective view of a multi-connector device according to an embodiment of the present invention, a pair of support housing members and pairs of connectors being shown in a disconnected state.
Figure 3:
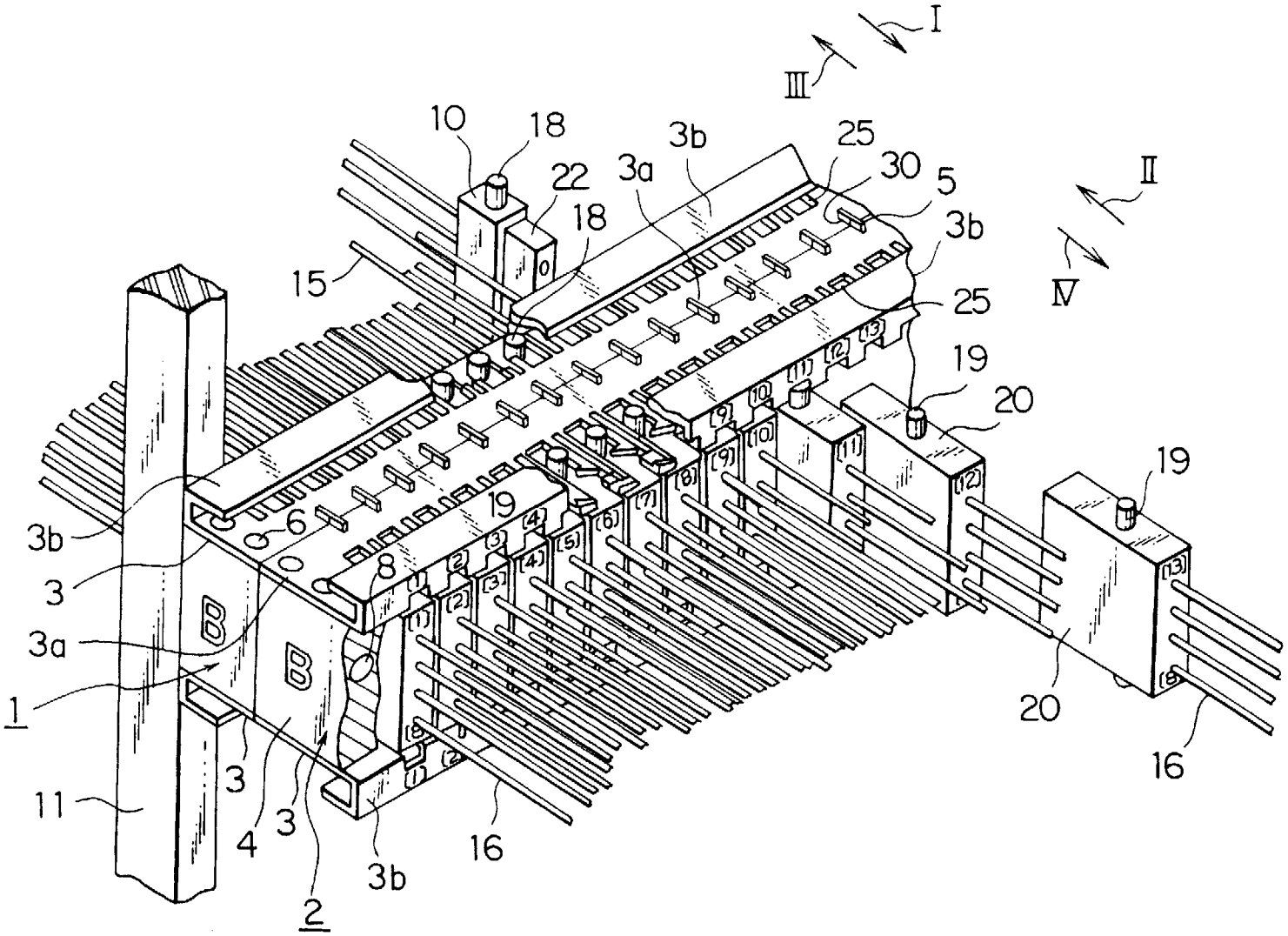
FIG. 3 is a perspective view of the multi-connector device of FIG. 2, but the pair of housing members shown in a connected states

Referring to FIGS. 2 and 3, a multi-connector device according to an embodiment of the present invention comprises a pair of first and second housing members 1 and 2 which have front surfaces to be confronted to each other. Those first and second housing members 1 and 2 are brought into contact with each other at the front surfaces and are removably jointed to each other to form a connector support housing for accommodating and supporting a plurality of pairs of first connectors 10 and second connectors 20. In the first housing member 1, first connectors 10 are removably mounted and are reciprocally movable in a first direction as shown by arrows I and III in FIG. 3 for connection and disconnection with second connectors 20. In the second housing member 2, the second connectors 20 are removably mounted and are reciprocally movable in the direction as shown by arrows II and IV in FIG. 3 in the similar manner as in first housing member 1.

The first and the second housing members 1 and 2 have symmetrical structures. The same reference numbers are given for the corresponding portions of the first and the second housing members 1 and 2.

Each of the housing members 1 and 2 comprises a pair of upper and lower frames 3 and 3 (in the figure) made of lengthy plates extending in parallel with each other, and a pair of frame blocks 4 which are joined to the upper and lower frames 3 and 3 by means of screws 6 at opposite ends (only one end being shown) of the frames 3 to form a housing. In order to separately accommodate a plurality of connectors, each of the housing members 1 and 2 is provided with a plurality of partitions 5 to separate a space in the housing into a plurality of chambers 7 which are arranged along the upper and lower frames 3 and between the frame blocks 4.

Figure 4:
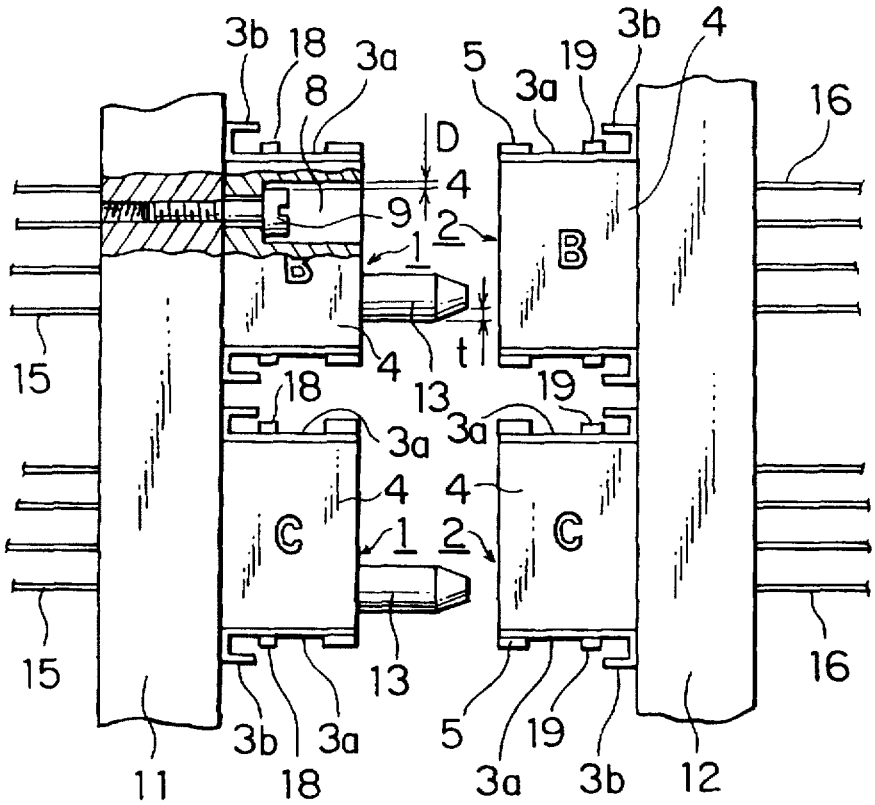
FIG. 4 is a partially exploded side view of two multi-connector devices of FIG. 2 mounted on different panels of different electrical apparatus to be electrically connected to each other.

Each of frame blocks 4 has a bolt receiving hole 8 extending in the first direction for receiving a bolt or floating screw 9 (FIG. 4). Frame blocks 4 of the first housing member 1 are provided with guide pins 13 projecting from their confronting surfaces facing to the other frame blocks 4 of the second housing member 2. The other frame blocks 4 of the second housing member 2 are provided with guide pin receiving holes 14 for receiving the guide pins 13.

Referring to FIG. 4, two multi-connector support housings B and C are mounted on panels 11 and 12 of different electric apparatus (not shown) to be electrically connected. The first and second housing members 1 and 2 of each multi-connector support housings B and C are attached onto the panels 11 and 12 in a floating state by floating screws 9 which are inserted through the bolt receiving holes 8 and are threaded into the panels.

Figure 5:
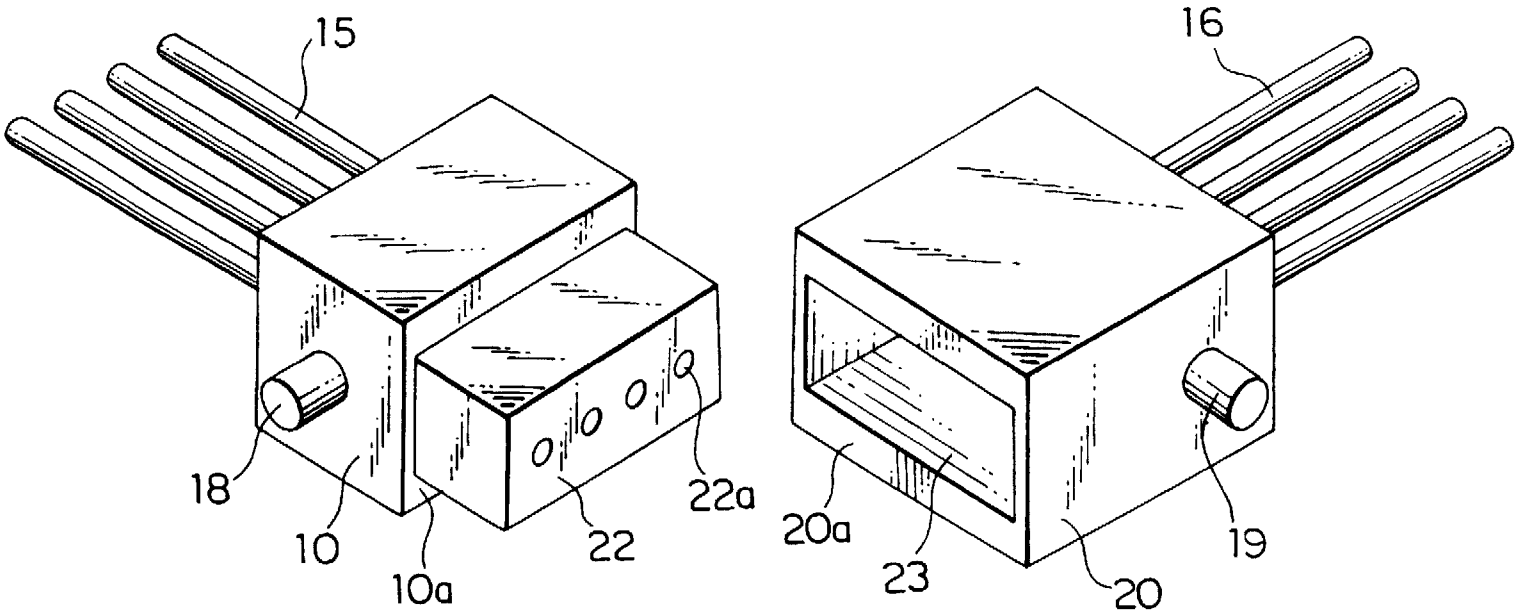
FIG. 5 is a perspective view of a pair of connectors used in the multi-connector device of FIG. 2, but in a disconnected state.

Referring to FIG. 5, there is shown a pair of the first connector 10 and the second connector 20. The first connector 10 accommodates first cables 15 to be electrically connected to second cables 16 which are accommodated in the second connector 20. The first connector 10 is provided with a pair of projections 18 (only one being shown) on the opposite side surfaces thereof and has a fitting portion 22 protruding from a base 10*a* to form a plug connector. The fitting portion 22 is provided with a plurality of (four being shown) contact holes 22*a* in which there are mounted socket contacts (not shown) connected to the first cables 15, respectively.

The second connector 20 is also provided with a pair of projections 19 (only one being shown) are formed on the opposite side surfaces thereof and has a fitting groove 23 in a base 20*a* thereof for receiving the fitting projection 22 of the first connector 10. Thus, the second connector 20 is shown as a receptacle. In the fitting groove 23, there are a plurality of pin contacts (not shown) to be brought into contact with the socket contacts of the first connector 10. The pin contacts are connected with the second cables 15.

Returning to FIGS. 2 through 4, each of upper and lower frames 3 comprises a plate portion 3*a* and a guide 3*b* extending along a side of the plate portion 3*a*. The guide 3*b* is formed by bending a side portion of a lengthy plate to remain the plate portion 3*a* as a flat plate section. In detail, the lengthy plate is bent twice to form the guide 3*b*, at first along an imaginary line X1 and secondly along another imaginary line X2, as shown in FIG. 6.

Figure 6:
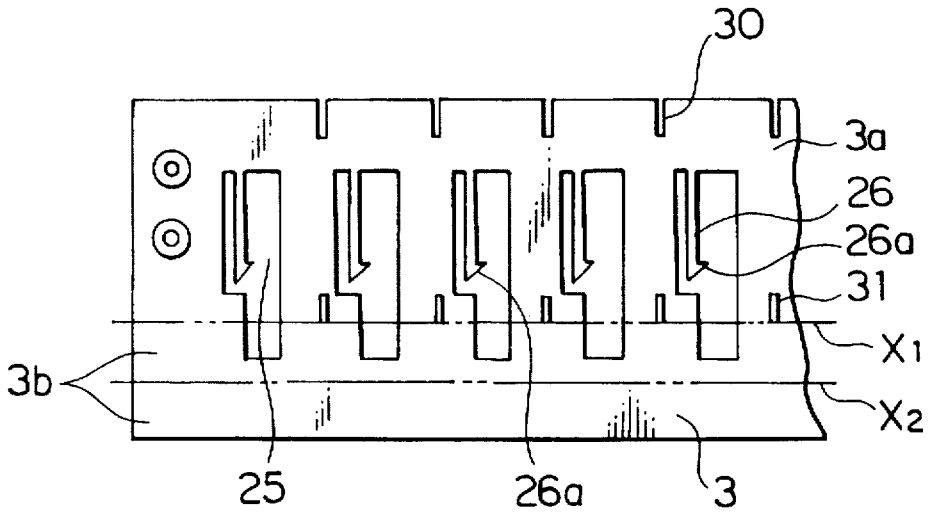
FIG. 6 is a developed plan view of a frame of the support housing member of the multi-connector device of FIG. 2.

Referring to FIG. 6 in addition to FIGS. 2 and 3, the frame plate portion 3*a* is formed with a plurality of long windows or slits 25 at spaced positions corresponding to chambers 7. Each of slits 25 extends in the first direction and is for engaging and guiding the projection 18 or 19 of the connector 10 or 20 accommodated and supported in the corresponding chamber 7. The frame plate portion 3*a* is further provided with locking spring pieces 26 projecting from front edges of the slits 25 inwardly in the first direction, respectively. Each of the locking spring pieces 26 is elastically deflectable in a second direction of a width of the plate portion 3*a* that is perpendicular to the first direction and has a hook 26*a* at its projecting end.

When each of the first and second connectors 10 and 20 are loaded or attached into each of the chambers 7 of the first and second housing members 1 and 2, it is inserted into the chamber from a rear side of the housing member 1 or 2, and projections 18 or 19 are inserted into the slits 26. At that time, the locking spring pieces 26 are elastically deformed in the second direction by projections 18 or 19 pushing the hooks 26*a*, so that the projections 18 or 19 are slipped into the slits 26 forward the hooks 26*a*. Thus, the connector 10 or 20 is locked in the chamber 7 by engagement of projections 18 or 19 with the hooks 26*a* and is limited in its movement in the first direction within a distance between the front edge of the slit 26 and the hook 26*a*.

Each of the frames 3 is formed with a plurality of small slits 30 at intervals in a front edge thereof and a plurality of small holes 31 at positions corresponding to the small slits 30 in a rear edge thereof. The partitions 5 are attached and fixed to the frames 3 by fitting finger portions of the partitions 5 into the small slits 30 and the small holes 31.

Figure 7:
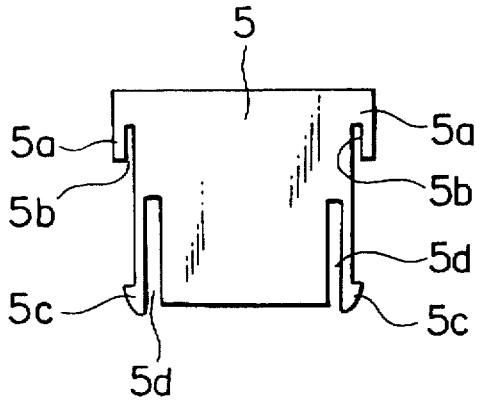
FIG. 7 is a plan view of a partition used in the support housing member of the multi-connector device of FIG. 2.

Referring to FIG. 7, the partition 5 is provided with front upper and lower fingers 5*a* with small slits 5*b* and rear upper and lower fingers 5*c* with small slits 5*d*. It is noted that the front end and the rear end are shown upper and lower, respectively in the figure. When the partition 5 is attached to the housing members 1 and 2, front fingers 5*a* and rear fingers 5*c* are fitted into the front small slits 30 and rear small holes 31 of the frames 3, respectively. Then, the frame portions 3*a* are inserted into slits 5*b*. The rear fingers 5*c* are provided with elasticity by slits 5*d* so that the rear fingers 5*c* are elastically fitted into the rear small holes 31.

Figure 8:
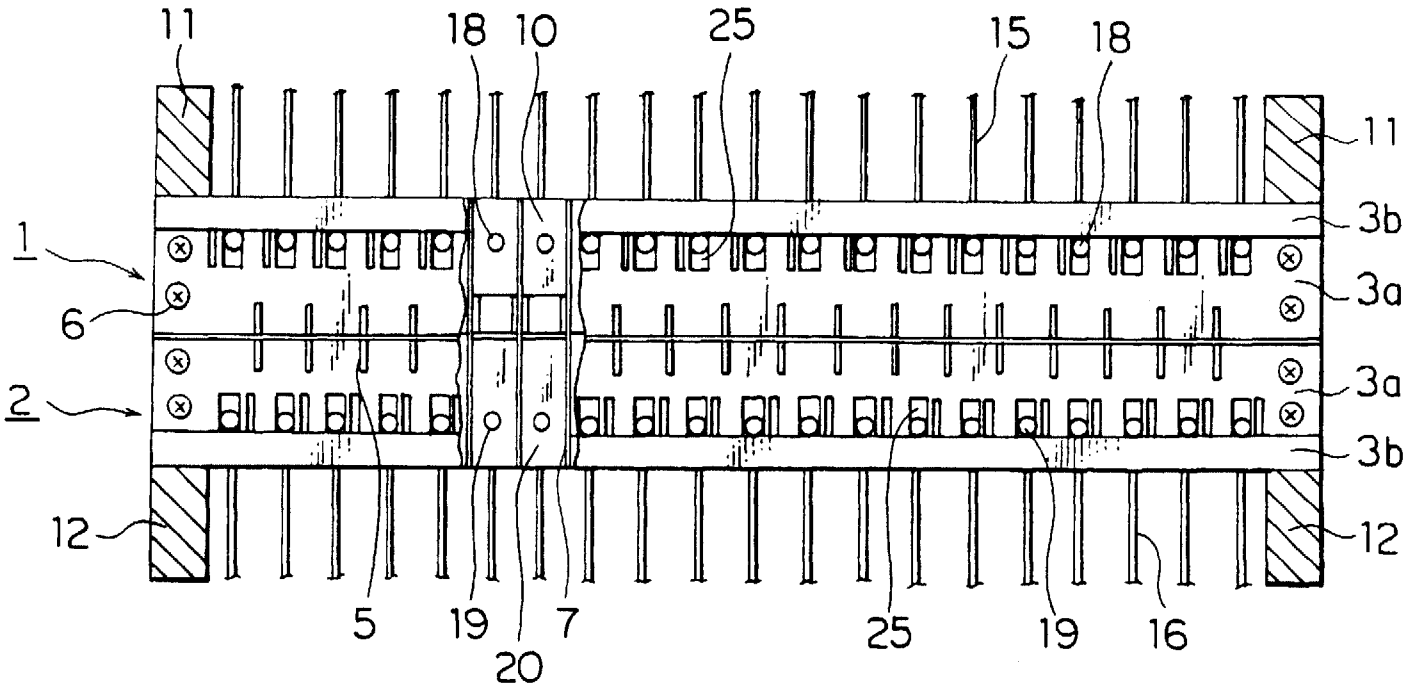
FIG. 8 is a plan view of the multi-connector device of FIG. 2, but in a state assembled to each other.

Referring to FIG. 8, the first and second housing members 1 and 2 are jointed together into an assembled body. In the condition, guide pins (13 in FIGS. 2 and 4) are inserted into guide pin receiving holes (14 in FIG. 2). Each of those housing members 1 and 2 are completely loaded with first connectors 10 and second connectors 20 into their chambers 7. Projections 18 and 19 of first and second connectors 10 and 20 are shown to be exposed through slits 25 of frames 3a.

In the shown example, there are 20 pairs of connectors loaded in those housing members. The first and second housing members 1 and 2 are shown to be fixed to the panels 11 and 12, respectively.

Figure 9:
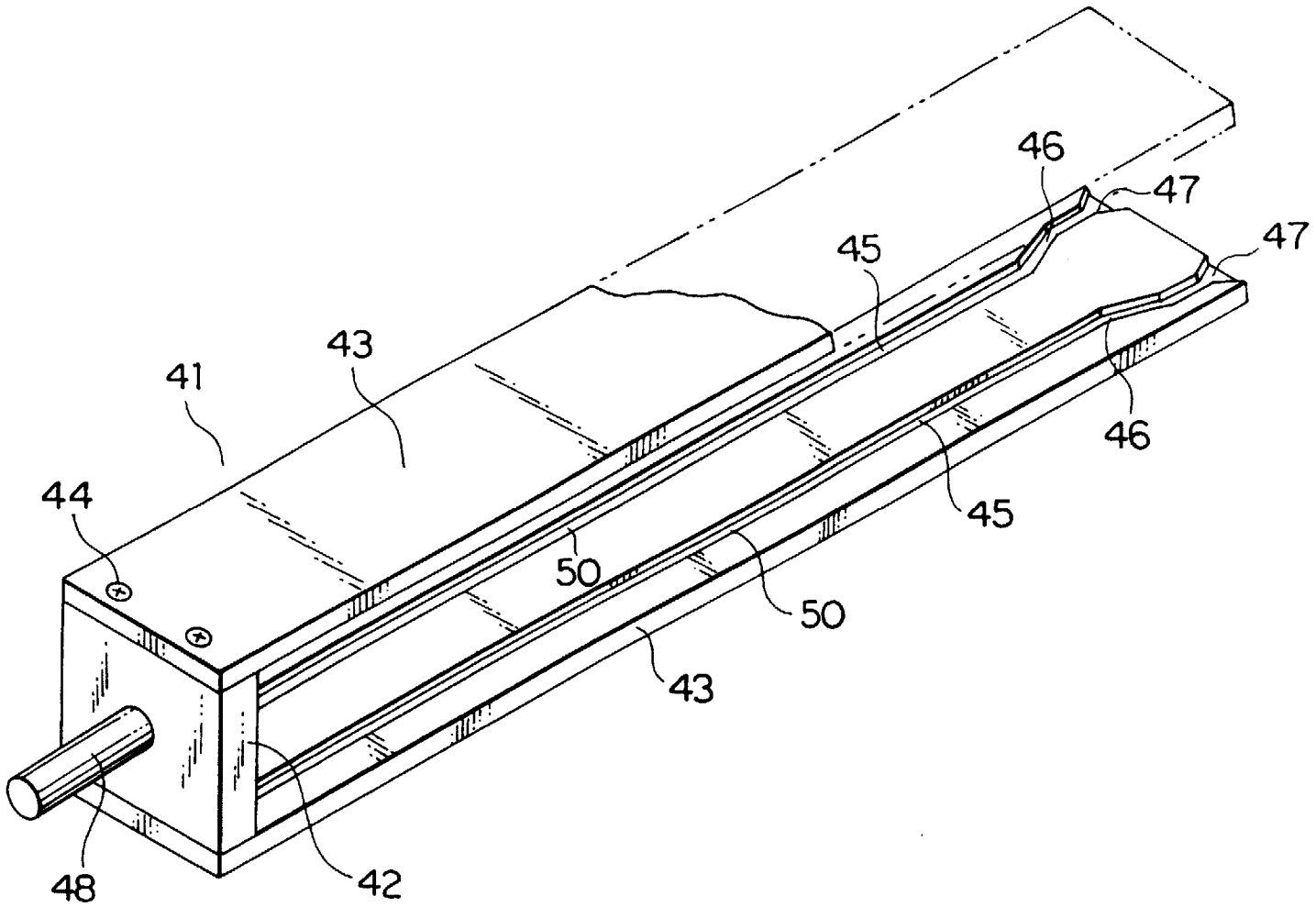
FIG. 9 is a perspective view of a slider used in the multi-connector device of FIG. 2.

Referring to FIG. 9, there is shown a slider 41 as a driving means. The slider 41 comprises a glider block 42 and a pair of slider plates 43 which are fixed at one end onto opposite upper and lower side surfaces of the slider block 42 by screws 44, respectively, and extend in parallel with each other from the slider block 42 to their free ends. Each of the slider plates 43 is formed with two guide grooves 50 which extend in parallel with each other from the slider block 42 towards the free end with a predetermined first distance left therebetween, as shown at 45. Those grooves 50 are directed outwardly as shown at 46 in the figure near the free end to go away from each other and ended to the free end with an enlarged second distance therebetween. The slider block 42 is provided with a handle 48 extending in a direction opposite to the slider plates 43.

The first distance corresponds to a distance between projections 18 and 19 of one pair of first and second connectors 10 and 20 which are in a connected condition, and the second distance corresponds to another distance between projections 18 and 19 of the one pair of first and second connectors 10 and 20 which are in a disconnected condition.

Each of the grooves 50 has a groove width corresponding to a size of each of the projections 18 and 19 and can receive the projections 18 and 19 therein. But each of the grooves 50 itself are diverged at the free end to form a large end opening 47.

Figure 10:
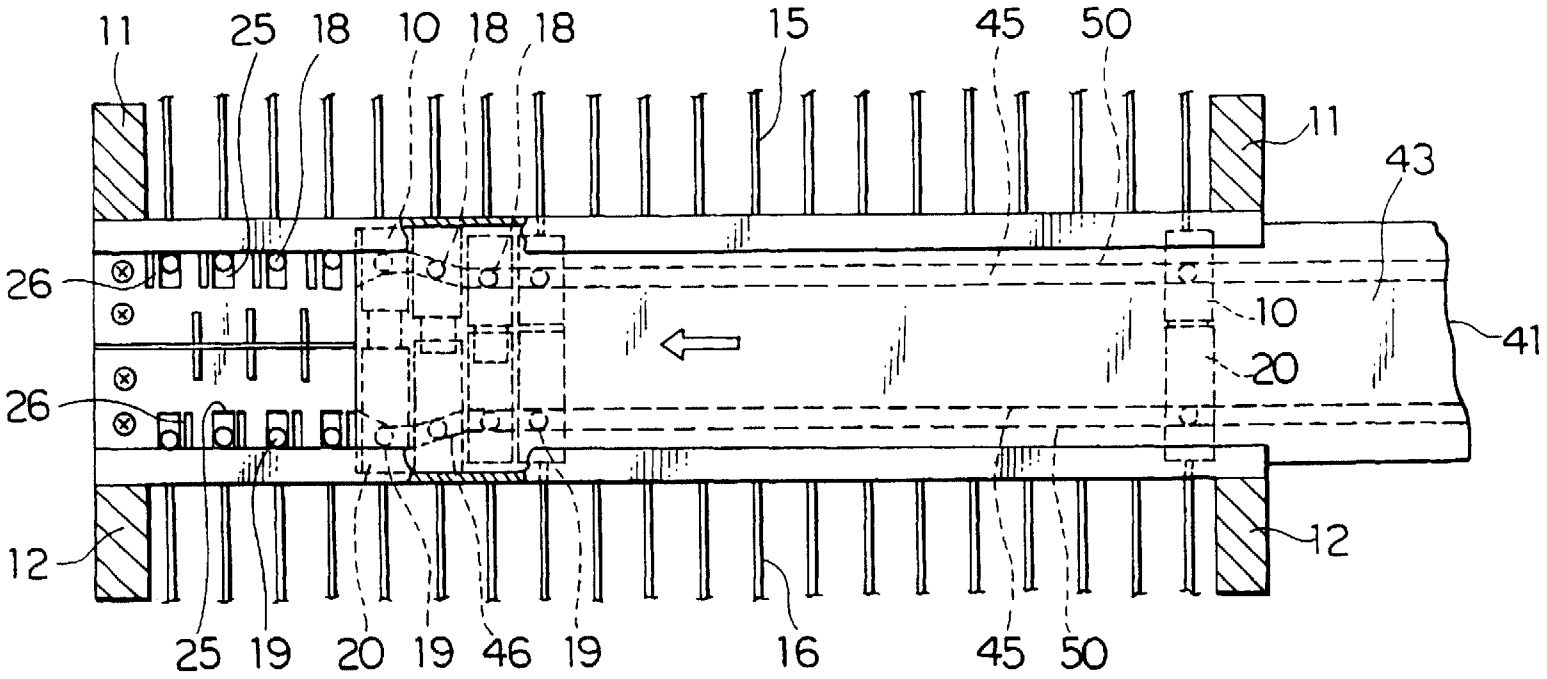
FIG. 10 is a plan view illustrating a condition where the slider of FIG. 9 is loaded onto the connector device of FIG. 8.

Referring to FIG. 10, the slider 41 is fitted onto the connector support housing of FIG. 8 wherein the first and second housing members 1 and 2 are jointed together and accommodate first and second connectors 10 and 20 which are disconnected to each other.

When the slider 41 is fitted onto the housings 1 and 2, the slider plates 43 are inserted into guides 3b on the upper and lower frames 3 of the housings 1 and 2 from one end thereof. Then, the projections 18 and 19 of one pair of first and second connectors 10 and 20 disposed adjacent the one end are guided into the divergent portions 46 of grooves 5 through large end openings 47. When the slider 41 is further progressed along the housings 1 and 2, projections 18 and 19 of the next adjacent pair of first and second connectors 10 and 20 are also guided into the divergent groove portions 46 through the opening edges 47. While, the projections 18 and 19 of the connectors adjacent the one end are guided into the parallel groove portions 45 with the first distance therebetween through the divergent portions 46 and thus are moved to be approached to each other to connect the first and the second connectors 10 and 20. In the similar manner, the plurality of pairs of first and second connectors 10 and 20 are successively connected one pair after another pair.

On the other hand, the slider 41 is retracted by pulling the handle 48, the projections 18 and 19 are guided through divergent groove portions 46 from the parallel portion 45 to the end portions 47 so that the first and the second connectors 10 and 20 are disconnected.

Figure 11:
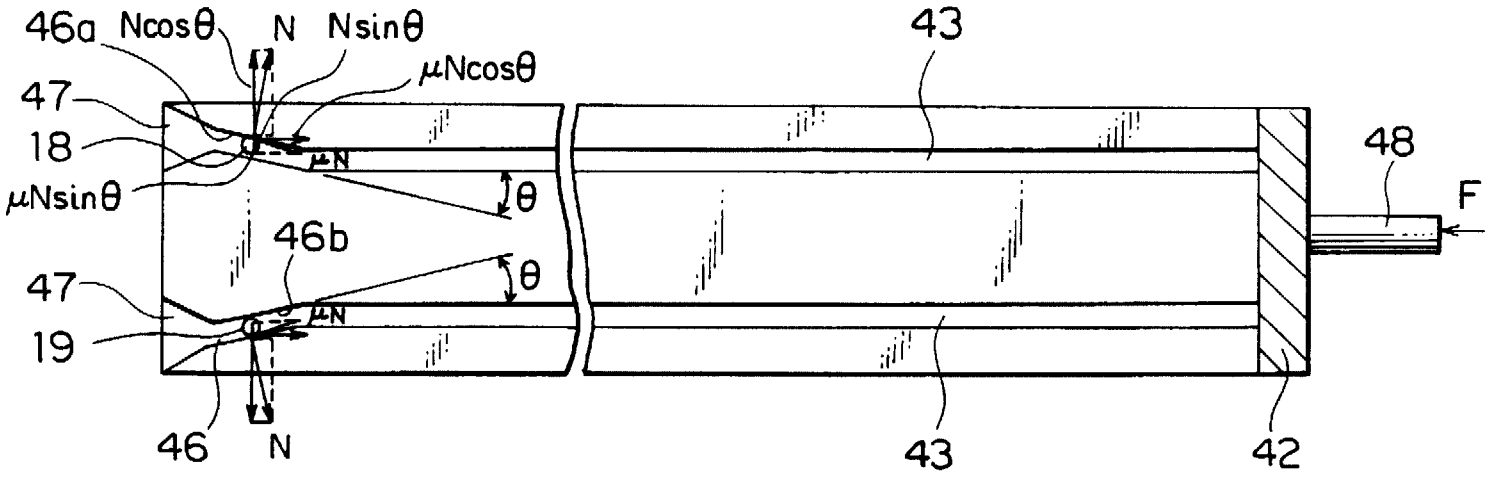
FIG. 11 is a plan view of the slider for illustrating its function.

Referring to FIG. 11, when the slider 41 is pushed by a force F to fit the slider 41 onto the housings 1 and 2, projections 18 and 19 are fitted onto side surfaces of the divergent groove portions 46, which, in turn, individually receive a reaction force N through projections 18 and 19 from the connectors 10 and 20 and a dynamic friction force $\mu N$, $\mu$ being a dynamic friction constant between the side surface and each of the projections 18 and 19. Since the side surfaces of the divergent groove portions 46 are inclined by an angle $\theta$ from the moving direction of the slider 41, the force represented by $N\sin\theta+\mu N\cos\theta$ is applied to the side surface of each of the divergent groove portions 46 in the moving direction. Therefore, the driving force F is given by $2N(\sin\theta+\mu\cos\theta)$ at minimum so as to move the slider 41 for connecting the first and the second connectors 10 and 20. In the direction perpendicular to the moving direction of the slider 41, a force applied to the side surfaces of the two divergent groove portions 46 is given by $N\cos\theta-\mu N\sin\theta-N\cos\theta+\mu N\sin\theta=0$. That is, no force other than the reaction force in the moving direction is caused by driving the slider 41.

Returning to FIG. 3, the first and second connectors 10 and 20 are given by indication of connector numbers in blocks, such as |1|, |2|, and so on. Further, the first and second housing members 1 and 2 also has indication of the connector numbers for identifying chambers 7. Those connector numbers on the first housing member 1 and the first connector 10 are not shown because they are hidden behind the first housing member 10. It should be noted that the first connector 10 and the paired second connector 20 should have the same connector number, and that the corresponding two chambers 7 in the first and the second housing members 1 and 2 should be identified by the same connector number as the pair of connectors 10 and 11 which should be loaded thereinto.

Accordingly, the first and second connectors 10 and 20 having the same connector number, such as No. n, are easily and correctly accommodated into the corresponding chambers 7 in the first and the second housing members 1 and 2. It is also easy to find out a particular pair of connectors 10 and 20 because the connectors are arranged in good order.

Further, connection or disconnection of a plurality of pairs of first and second connectors 10 and 20 can be readily performed by one driving stroke of the slider 41, that is, pushing operation or pulling operation.

Figure 12:
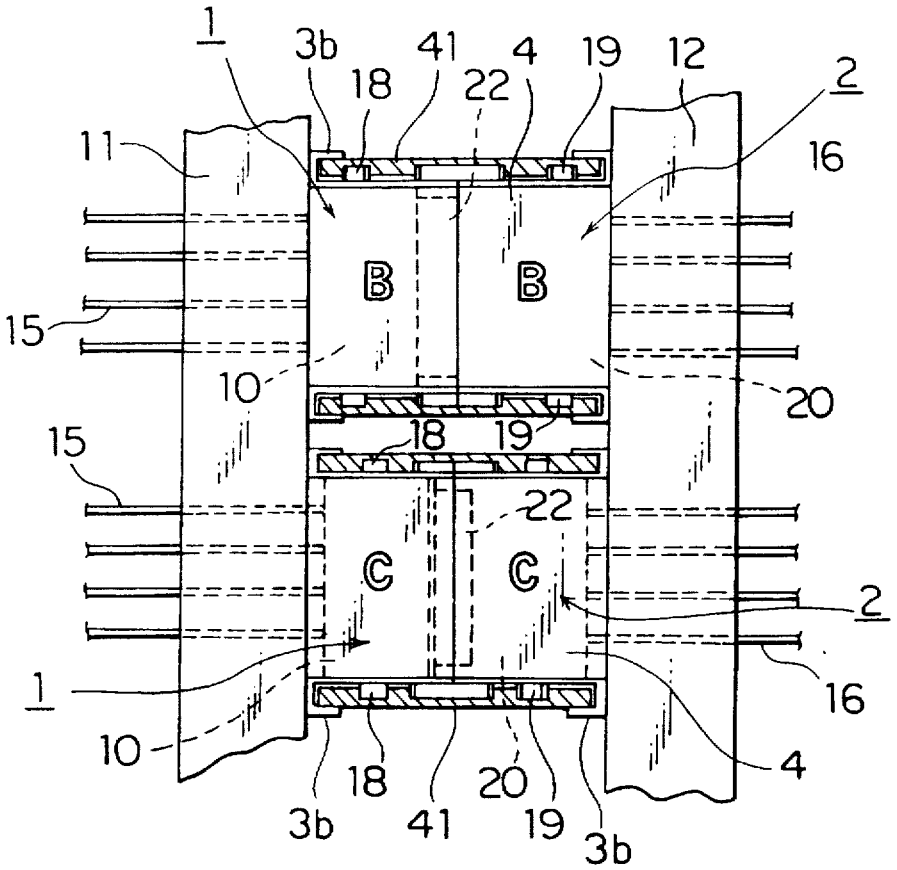
FIG. 12 is a partially exploded side view similar to FIG. 4, illustrating connectors connected and disconnected.

Referring to FIG. 12, two pairs B and C of the first and second housing members 1 and 2 are mounted at upper and lower positions on the panels 11 and 12 and are jointed together. The first and second connectors 10 and 20 in the upper position are not yet connected as will be understood from the positions of projections 18 and 19 which are away from each other. On the other hand, the first and second connectors 10 and 20 in the lower position are already connected as will be understood from the positions of projections 18 and 19 which are close to each other.

The jointed condition of FIG. 12 is brought from the separated condition of FIG. 4. In the course, the guide pins 13 of the first housing member 1 are inserted into guide pin receiving holes (14 in FIG. 2) of the second housing member 2. Although the positional relationship between the upper and lower first housing member 1 on the panel 11 are different from the positional relationship between the upper and lower second housing member 2 on the panel 12, upper and lower first housing members 1 can be correctly coupled or jointed with the upper and lower second housing members 2, respectively, because they are attached to the panels 11 and 12 in the floating condition and the guide pins 13 have taper ends. It is necessary that the positional difference between the corresponding housing members 1 and 2 is equal to or smaller than an amount t of the taper which should be larger than twice the floating amount D of the housing member 1 and 2. The floating amount is given by a gap between the inner wall of the bolt receiving hole 8 and a head of the floating screw 9.

Figure 13:
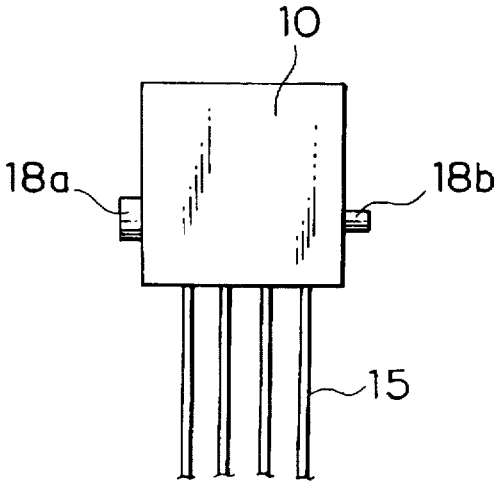
FIG. 13 is a side view of another example of the connector used in the multi-connector device.

Referring to FIG. 13, another example of connector 10 or 20 shown therein has a pair of projections 18*a* and 18*b* which are different in size. In use of the connector, the guide engaging slits 25 in the upper frame and those in the lower frame are formed different in size and are corresponding to different projections 18*a* and 18*b*, respectively. Thus, the connector can be accommodated into the chamber 7 with a correct orientation without a reversed orientation.

The pairs of first and second connectors 10 and 20 can be formed different from one another in size and chambers 7 are formed with different sizes corresponding to the connector pairs. Thus, the connector pairs can readily be loaded into the correct chambers 7.

Another multi-connector device according to another embodiment is shown in FIGS. 14 through 19.

The multi-connector device of this embodiment is similar to that of the prior embodiment shown in FIGS. 2 through 13 except that a connector support housing 100 is formed in a single body without being separated into the first and the second housing members 1 and 2 in the prior embodiment. Accordingly, the housing 100 does not have any guide pin 13 and guide pin receiving holes 14 in the prior embodiment.

The connector support housing 100 comprises an upper frame and a lower frame 103, four frame blocks 104 which are fixed to the upper and lower frames 103 at opposite ends by screws 106, with each two frame blocks being arranged at each one end, to form a housing, and partitions 105 fixed in the housing to separate an inner space of the housing into a plurality of chambers 107 in which a plurality of pair of connectors 10 and 20 are loaded.

Figure 14:
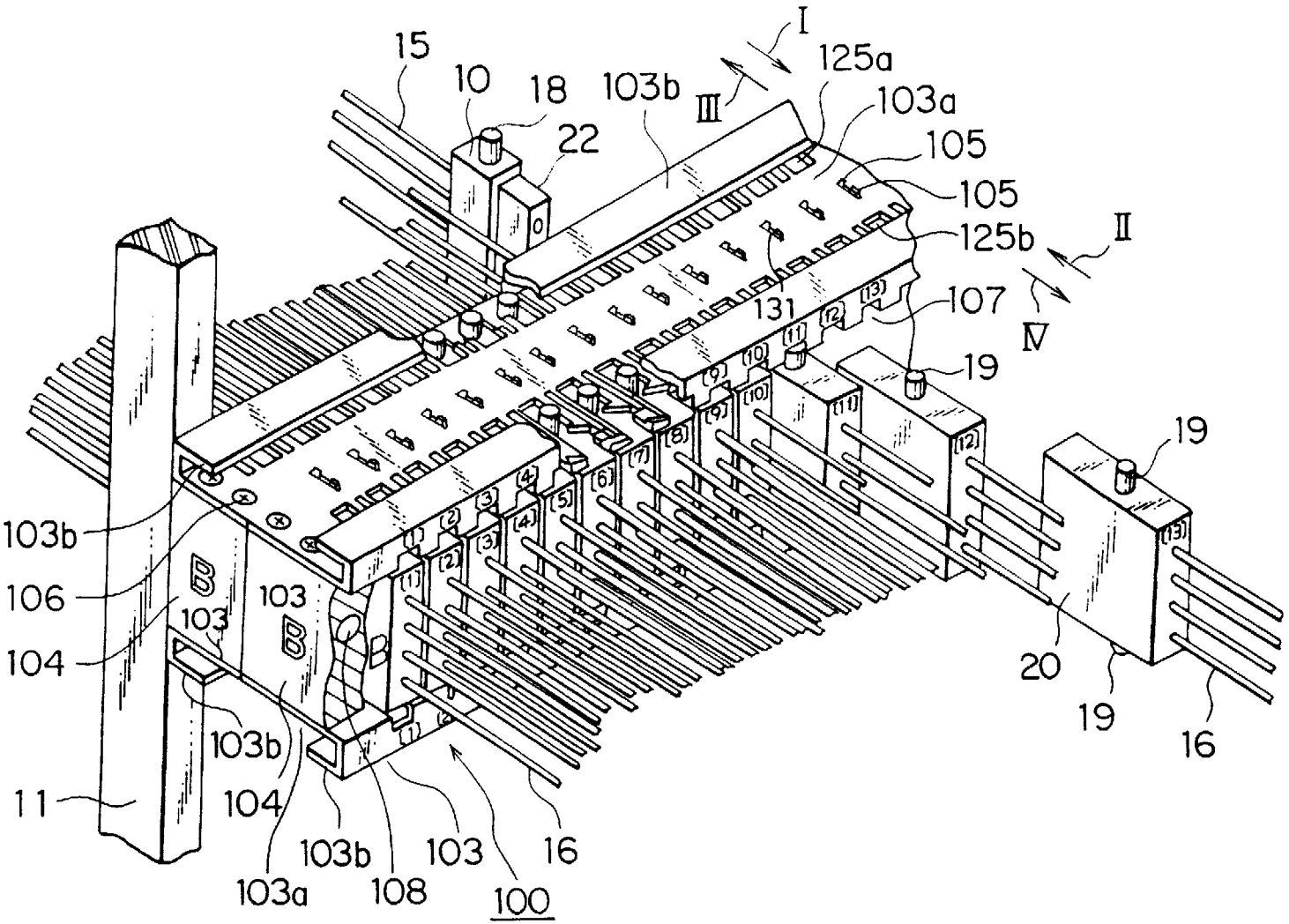
FIG. 14 is perspective view of a multi-connector device according to another embodiment of the present invention, with connectors partially loaded.
Figure 15:
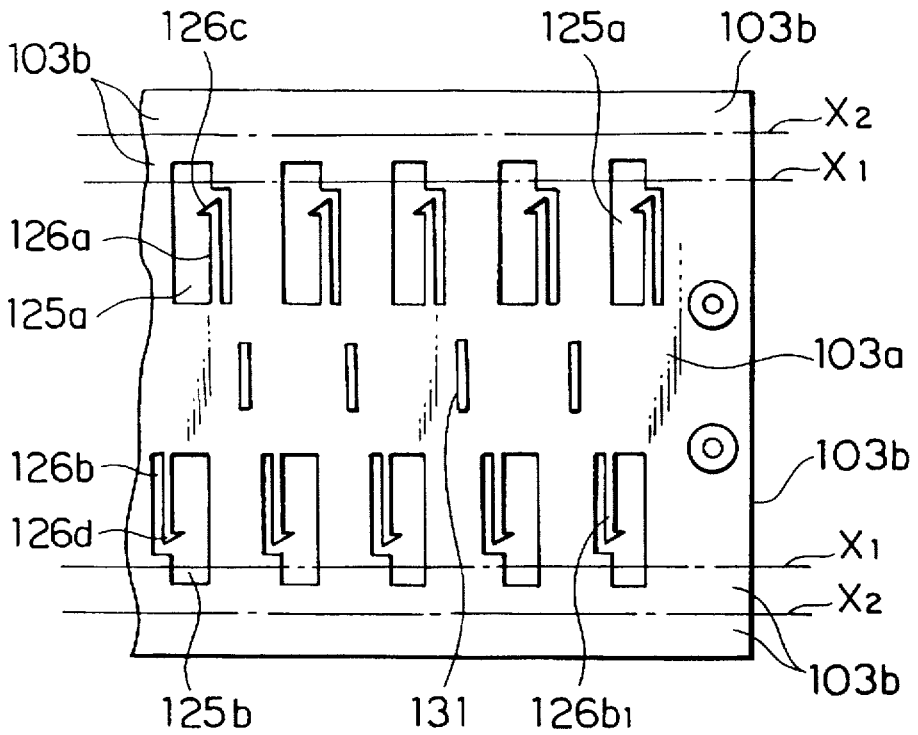
FIG. 15 is a developed plan view of a frame of a support housing of the multi-connector device.

Each frame 103 has two guides 103*b* along both side edges as shown In FIG. 14 which are formed by bending both sides of a plate 103*a* twice, firstly along an imaginary line X1 and then another Imaginary line X2 as shown In FIG. 15. The plate portion of the frame 105 is provided with a plurality of pairs of guide engaging slits 125*a* and 125*b* between the two guides 103*b* and locking spring pieces 126*a* and 126*b* and hooks 126*c* and 126*d* in the slits 125*a* and 125*b*. A plurality of slits 125*a* are arranged to form a first slit row along one of the guides 103*b* and another plurality of slits 125*b* are also arranged to form a second slits row along the other guide 125*b*. The guide engaging slits 125*a* and 125*b* with locking spring pieces 126*a* and 126*b* with hooks 126*c* and 126*d* are for guiding and engaging projections 18 of the first connectors 10 and projections 19 of the second connectors 20.

The frame 103 is further formed with a series of small slits 131 between the first and the second slits rows of the guiding engagement slits 125*a* and 125*b*. The small slits are for fixing partitions 105 to the support housing 100.

Figure 16:
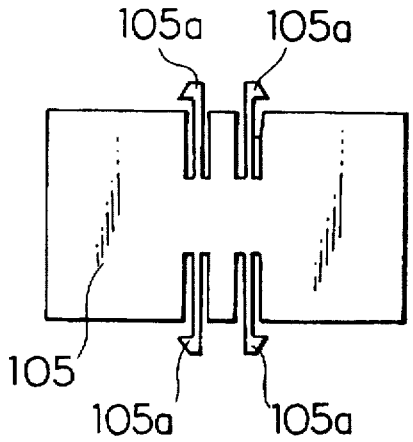
FIG. 16 is a plan view of a partition of the support housing of FIG. 15.

Referring to FIG. 16, the partition 105 is provided with an upper and lower pair of fingers 105*a*. Those fingers are fitted into the small slits as shown in FIG. 14.

Since the other parts and assembling structures are similar to those in FIGS. 2 through 13, they are shown by the same reference numerals and are not described again for the purpose of simplification of the description.

Figure 17:
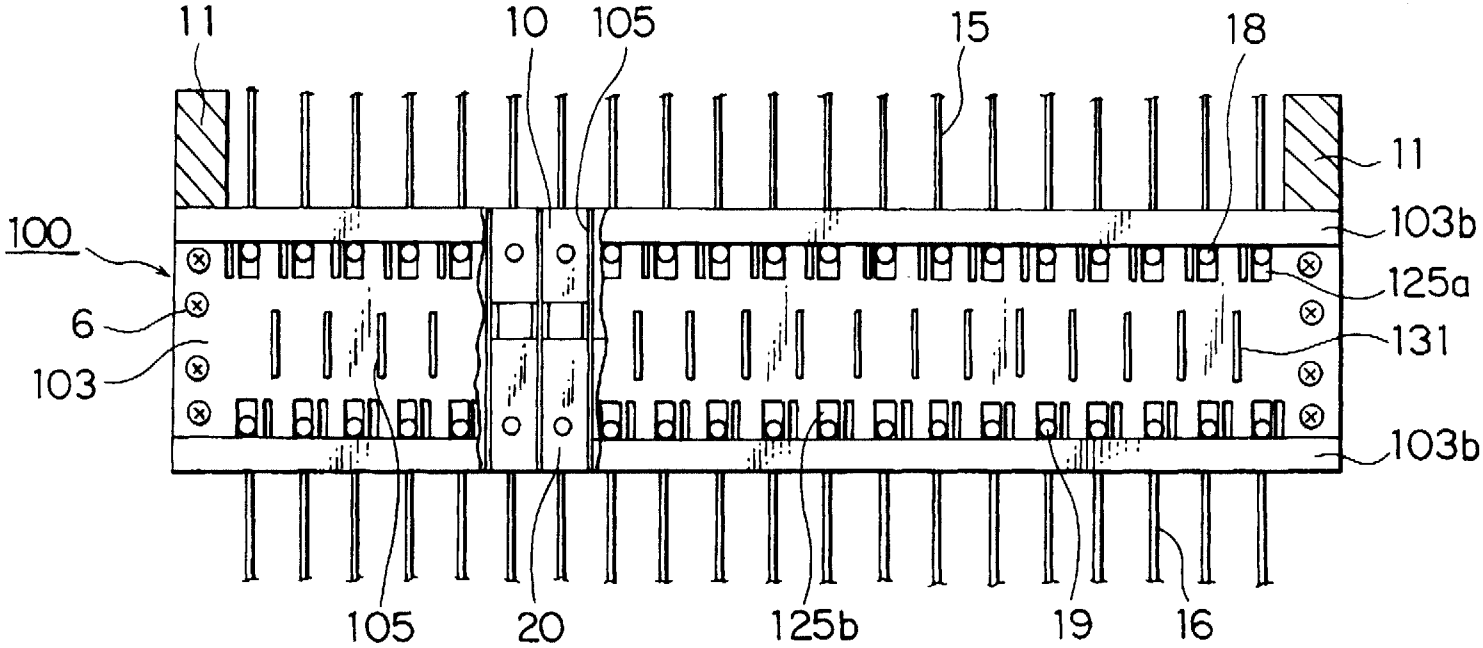
FIG. 17 is a plan view of the multi-connector device of FIG. 14 with connectors being completely mounted.
Figure 18:
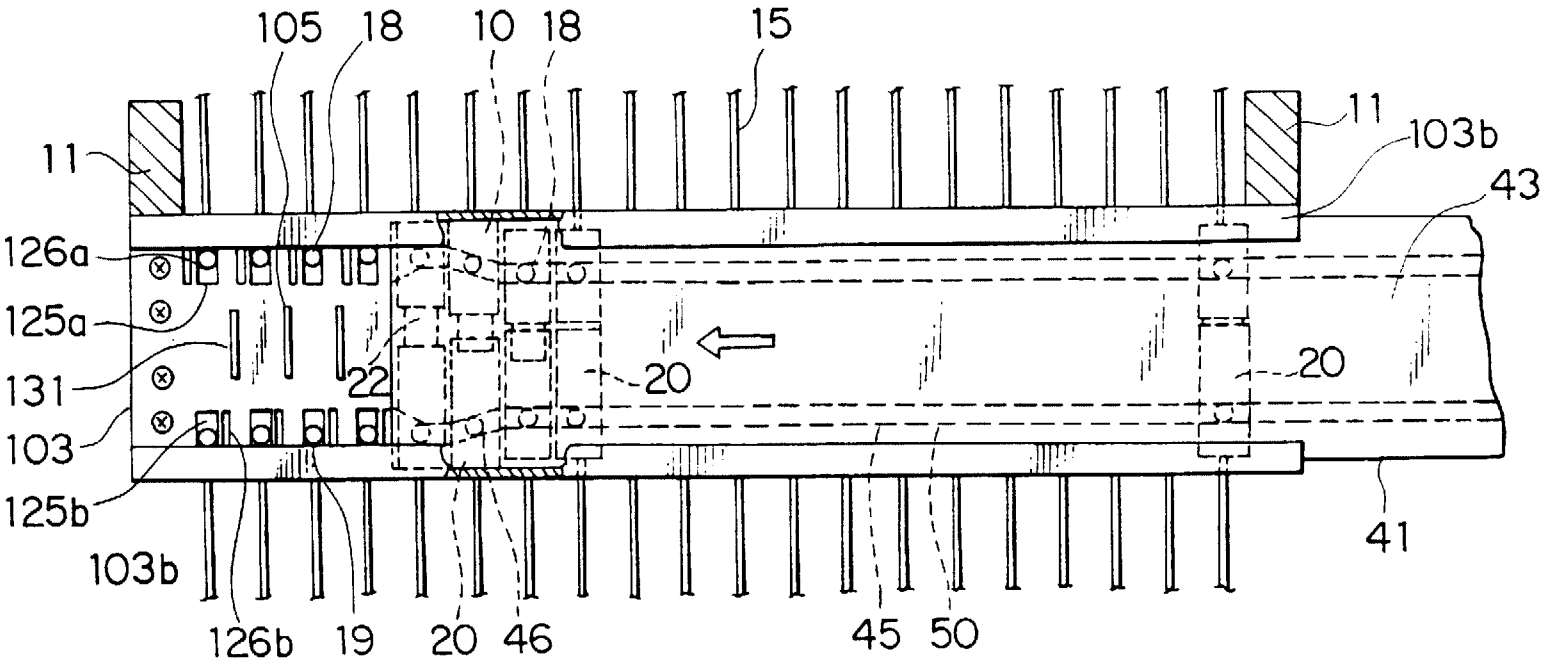
FIG. 18 is a plan view illustrating a condition where the slider of FIG. 9 is loaded onto the connector device of FIG. 17.

Referring to FIGS. 14, 17 and 18, the first connectors 10 and the second connectors 20 are loaded into chambers 107 of the connector support housing 100 from the both sides, respectively.

Figure 19:
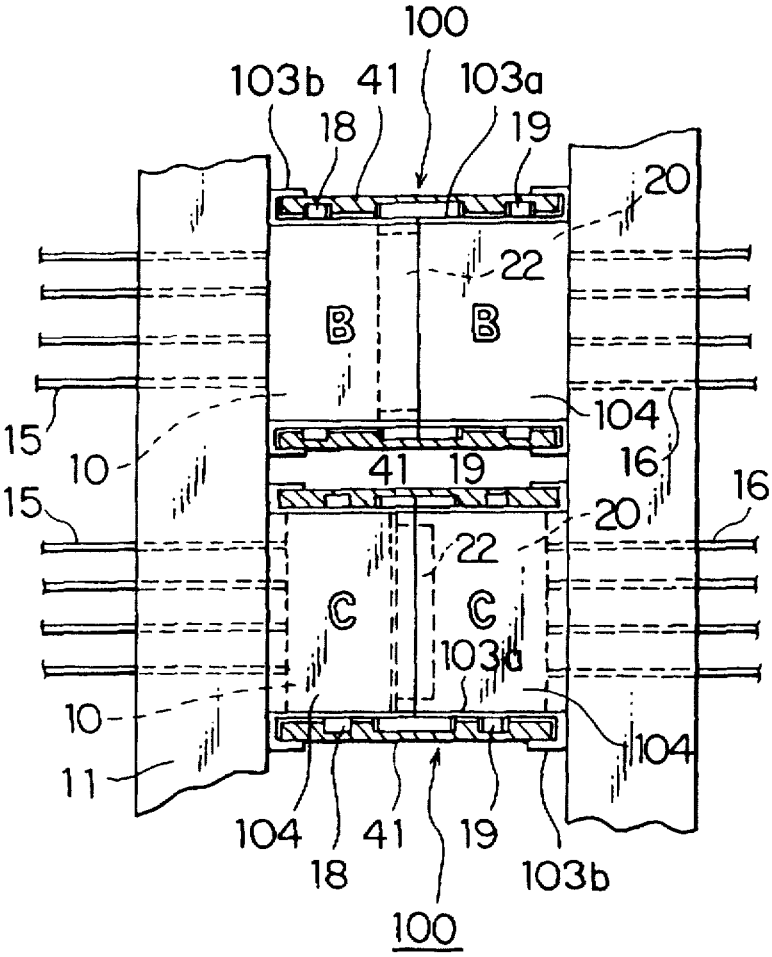
FIG. 19 is a partially exploded side view of two multi-connector devices of FIG. 14 mounted on a panel of an electric apparatus, illustrating connectors connected and disconnected.

Referring to FIGS. 18 and 19, the first and the second connectors 10 and 20 are connected and disconnected to and from each other by application of the slider 41 of FIG. 9 onto the connector support housing 100. In FIG. 19, two connector support housings B and C are mounted on a panel of an electric apparatus but not a panel of another electric apparatus. In the upper connector support housing B, first and second connectors 10 and 20 are shown in a disconnected condition, but the first and the second connectors 10 and 20 in the lower connector support housing C are shown in a connected condition.

What is claimed is:

1. A multi-connector support device with a connection/disconnection mechanism which comprises:

a support housing defining a hollow space and having a plurality of partitions fixed at spaced positions to separate said hollow space into a plurality of connector accommodating chambers therein which are arranged in order for accommodating a plurality of pairs of connectors therein, respectively;

a plurality of pairs of guide engaging portions formed on said support housing at said connector accommodating chambers for engaging said pairs of connectors accommodated in said chambers and guiding said pairs of connectors to move in connecting and disconnecting directions in said chambers, respectively; and a connector driving means removably assembled onto said support housing for driving said pairs of connectors in a selected one of the connecting and disconnecting directions.

2. A multi-connector support device with a connection/disconnection mechanism which comprises:

a support housing defining a hollow space and having a plurality of partitions fixed at spaced positions to separate said hollow space into a plurality of connector accommodating chambers therein which are arranged in order for accommodating a plurality of pairs of connectors therein, respectively;

a plurality of pairs of guide engaging portions formed on said support housing at said connector accommodating chambers for engaging said pairs of connectors accommodated in said chambers and guiding said pairs of connectors to move in connecting and disconnecting directions in said chambers, respectively;

a connector driving member removably assembled onto said support housing to drive said pairs of connectors in a selected one of the connecting and disconnecting directions;

wherein said support housing comprises:

a pair of frames extending in parallel with each other; and a pair of frame blocks being fixed to opposite ends of said pairs of frames to fixedly maintain said pair of frames in the parallel condition to form said hollow space.

3. A multi-connector support device as claimed in claim 2, each of said pairs of connectors having a projection on at least one side surface thereof, wherein at least one of said frames is provided with a plurality of pairs of guide slits at positions corresponding to the chambers, each being for receiving said projection of each of said connector to provide each of said pairs of guide engaging portions.

4. A multi-connector support device as claimed in claim 3, each of said pairs of connectors having two projections different from each other in a sectional size on opposite side surfaces thereof, wherein one of said frames is provided with a plurality of first pairs of guide slits at positions corresponding to the chambers, each of first pairs being for guiding and engaging with one of said different projections of said connector, and the other frame is provided with a plurality of second pairs of guide slits at positions corresponding to the chambers, each or said second pairs being for guiding and engaging with the other of said different projections of said connector.

5. A multi-connector support device as claimed in claim 3, wherein said at least one frame is provided with a plurality of hooks each extending in each of said slits for engaging said projection to prevent said connector from slipping off from said support housing.

6. A multi-connector support device as claimed in claim 3, wherein said connector driving means comprises a slider slidably mounted on said at least one of said pair of frames, said slider engaging said projection of each of said connectors to drive said connectors by sliding movement of said slider.

7. A multi-connector support device as claimed in claim 6, wherein said slider is provided with a pair of grooves in one surface thereof, each extending in a sliding direction of said sliding movement, each of said grooves engaging with said projection of each of said connectors.

8. A multi-connector support device as claimed in claim 7, wherein said pair of grooves have a parallel groove portions extend in the sliding direction with a first distance therebetween, divergent groove portions with an increased distance therebetween, and end opening portions with a second distance therebetween larger than said first distance at an end of said slider.

9. A multi-connector support device as claimed in claim 7, wherein said at least one of said frames is provided with guide means for guiding sliding movement of said slider.

10. A multi-connector support device as claimed in claim 7, wherein said pairs of connectors have indications of connector numbers assigned to the pairs, and said support housing has indications of the same connector numbers at positions of corresponding to the connector pairs.

11. A multi-connector support device as claimed in claim 1, wherein said support housing has a pair of housing members which are removably jointed to each other, one of said pair of housing members being for accommodating a plurality of connectors, the other housing member being for accommodating other connectors mating thereto, said pairs of guide engaging portions being separately provided onto the pair of housing members, respectively.

12. A multi-connector support device as claimed in claim 11, wherein one of said housing members has at least one guide pin, and the other housing member has at least one of receiving hole for receiving said at least one of guide pin when said housing members are jointed together.

13. A multi-connector support device as claimed in claim 12, wherein each of said guide pin has a tapered end.

14. A multi-connector support device with a connection/disconnection mechanism which comprises:

a support housing defining a hollow space and having a plurality of partitions fixed at spaced positions to separate said hollow space into a plurality of connector accommodating chambers therein which are arranged in order for accommodating a plurality of pairs of connectors therein, respectively;

a plurality of pairs of guide engaging portions formed on said support housing at said connector accommodating chambers for engaging said pairs of connectors accommodated in said chambers and guiding said pairs of connectors to move in connecting and disconnecting directions in said chambers, respectively;

a connector driving member removably assembled onto said support housing to drive said pairs of connectors in a selected one of the connecting and disconnecting directions;

wherein said support housing has a pair of housing members which are removably joined to each other, one of said pair of housing members accommodating a plurality of connectors, the other housing member accommodating other connectors mating thereto, said pairs of guide engaging portions being separately provided onto the pair of housing members, respectively;

wherein each of said housing members has a plurality of bolt receiving holes for receiving floating screws therein for attaching each of said housing members onto a panel of an electrical apparatus.

15. A multi connector device which comprises a plurality of connector pairs of first connectors and second connectors with a one to one mating thereto, and a multi-connector support housing for accommodating said plurality of connector pairs, said multi-connector support housing comprising:

A support housing defining a hollow space and having a plurality of partitions fixed at spaced positions to separate said hollow space into a plurality of connector accommodating chambers therein which are arranged in order and accommodate said connector pairs therein, respectively;

a plurality of pairs of guide engaging portions formed on said support housing at said connector accommodating chambers and engaging said connector pairs accommodated in said chambers and guiding said connector pairs to move in connecting and disconnecting directions in said chambers, respectively; and a connector driving means removably assembled onto said support housing for driving said connector pairs in a selected one of the connecting and disconnecting directions.

* * * * *

UNITED STATES PATENT AND TRADEMARK OFFICE

CERTIFICATE OF CORRECTION

| | | |
|---|---|---|
| PATENT NO. | : | 5,795,174 |
| DATED | : | August 18, 1998 |
| INVENTOR(S) | : | Kazuki Saito; Sunao Sekiguchi; Hisashi Ishida |

It is certified that error appears in the above-indentified patent and that said Letters Patent is hereby corrected as shown below:

Column 7, Line 44, delete "In" and insert --in--
Column 7, Line 44, delete "Imaginary" and insert --imaginary--
Column 8, Line 8, delete --of Fig. 9--.

Signed and Sealed this

Nineteenth Day of January, 1999

*Attest:*

*Attesting Officer*

*Acting Commissioner of Patents and Trademarks*